United States Patent [19]

Fornasiero

[11] 4,230,062

[45] Oct. 28, 1980

[54] RELEASABLE BOAT ANCHOR

[76] Inventor: Peter J. Fornasiero, 54,638 Starlite, Utica, Mich. 48087

[21] Appl. No.: 968,793

[22] Filed: Dec. 12, 1978

[51] Int. Cl.[3] ..... B63B 21/38

[52] U.S. Cl. ..... 114/297

[58] Field of Search ..... 114/297, 298, 301, 304, 114/305, 294, 299, 302, 303

[56] References Cited

U.S. PATENT DOCUMENTS

| | | | |
|---|---|---|---|
| 1,373,741 | 4/1921 | Jones | 114/305 |
| 2,720,184 | 10/1955 | Polenz | 114/298 |
| 2,789,526 | 4/1957 | Gollner | 114/298 |
| 3,509,846 | 5/1970 | Hrivnyak et al. | 114/298 |
| 4,134,355 | 1/1979 | Carruthers | 114/304 X |

*Primary Examiner*—Charles E. Frankfort

*Attorney, Agent, or Firm*—William L. Fisher

[57] ABSTRACT

An improved releasable boat anchor of the double-acting type for anchoring a boat and for releasing itself from an underwater obstruction in which the anchor may be captured, the anchor comprising a fluke body and a shank, the shank comprising an intermediate portion pivotally connected to the fluke body and an outer portion pivotally connected to the intermediate portion, the outer shank portion having an aperture for attaching an anchor line to the anchor, the anchor having two alternate anchor drag positions, an intermediate release position and a full release position, said anchor including an arrangement such that in the full release position the pull on the fluke body is substantially from the rear thereof.

4 Claims, 12 Drawing Figures

RELEASABLE BOAT ANCHOR

My invention relates to anchors.

The principal object of my invention is to provide an improved releasable boat anchor of the double-acting type.

The foregoing object of my inventon and the advantages thereof will become apparent during the course of the following description, taken in conjunction with the accompanying drawings, in which:

FIG. 1 is a side elevational view of a releasable anchor embodying my invention shown in drag position;

FIGS. 2—4 are, respectively, opposite end elevational and top plan views of said embodiment FIG. 5 is a vertical sectional view of the structure of FIG. 4 taken on the line 5—5 thereof;

Figures 1, 2, 3, 4, 5, 6:
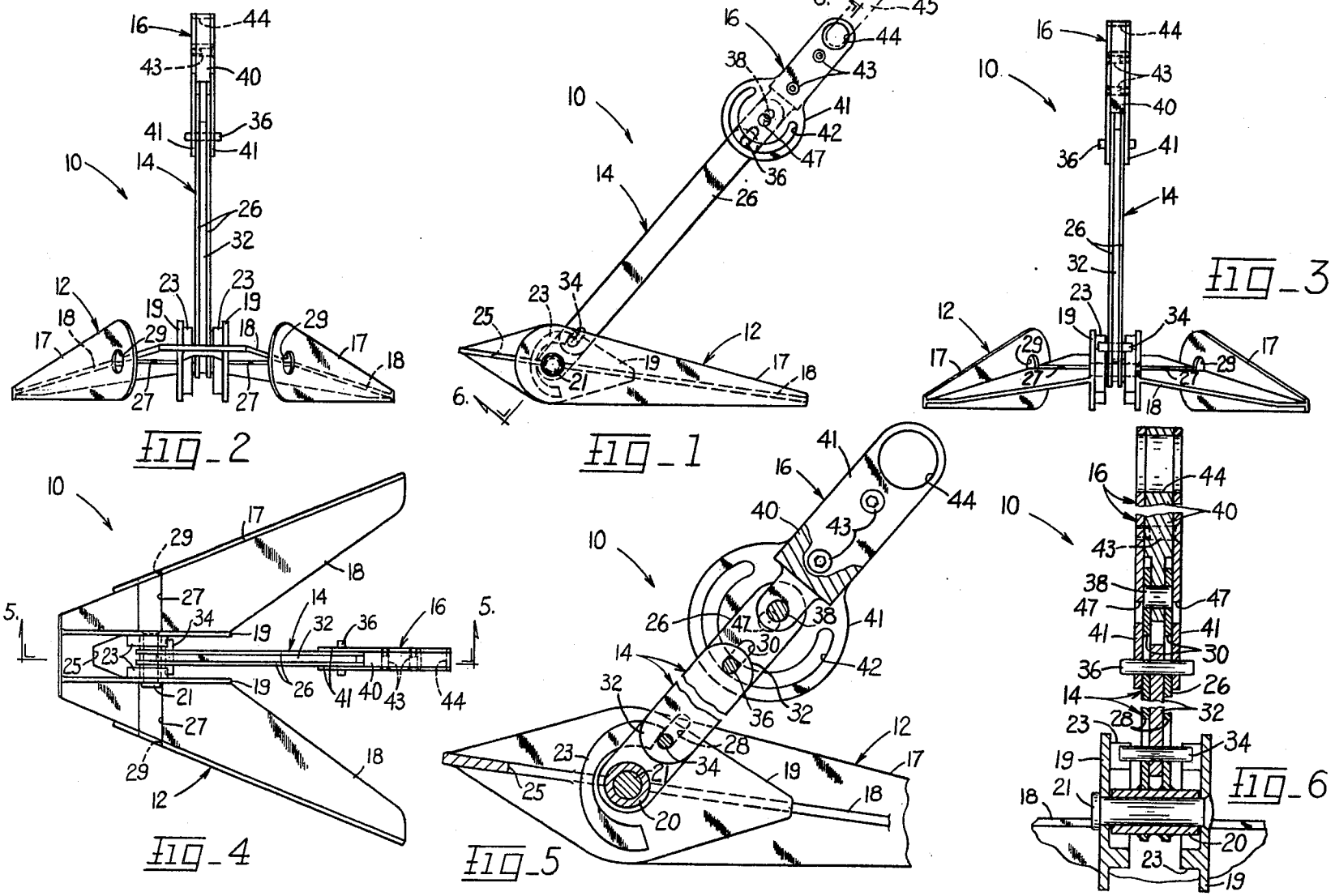
FIG. 6 is a vertical section view of the structure of FIG. 1 taken on the line 6—6 thereof.

Referring to the drawings in greater detail, 10 generally designates said embodiment which comprises a fluke body 12 and a shank pivotally connected to said fluke body 12 via a pivot pin 21 held in said fluke body 12. Said shank is formed of two portions, an intermediate portion 14 and an outer portion 16.

Said fluke body 12 is made of a flat plate 18 provided with divergent portions or flukes, as shown, for digging into the bottom of the body of water in which the boat is used. Said fluke body 12 includes outside and inside walls 17 and 19, respectively, formed at the edges of said plate 18; said walls 17 and 19 are perpendicularly disposed in respect to said plate 18. The outside walls 19 diverge with the divergent portions or flukes as they extend toward the digging end of the fluke body 12. Spaced apart apertures, as at 29, are formed in said walls and a slot 27 is formed in said plate 18 to accomodate said pivot pin 21. The inside walls 19 are parallel to each other and spaced apart to accomodate pivotal movement of said shank and the rear portion of plate 18 is provided with a slot 25 for this same purpose. A pair of arcuately shaped stops 23 are formed on the inside faces of said inside walls 19. Said stops 23 have two sets of shoulders disposed above and below said pivot pin 21 and facing the digging end of said fluke body 12.

Said intermediate portion 14 consists of a pair of spaced apart plates 26 and a center plate 32 disposed between said plates 26 and axially moveable in respect thereto. A bearing 20 is affixed to the lower ends of the plates 26 and disposed between said inside walls 19. Said bearing 20 is fitted over said pivot pin 21 so as to be rotatable thereon, whereby said shank portion 14 can pivot in respect to the fluke body 12. The plates 26 are provided with axial slots 28 and 30 at their inner and outer ends, respectively. The inner and outer ends of the plate 32 is provided with laterally projecting pins 34 and 36 which are moveably disposed in said slots 28 and 30, respectively.

Said intermediate and outer shank portions 14 and 16, respectively, are pivotally connected together via a pivot pin 38 fastened in apertures in the outer ends of said plates 26. Said outer shank portion 16 is formed in three parts, in the instance shown, viz., a pair of spaced apart plates 41 and a center bar 40, all fastened together by fasteners 43. The fastened together plates 41 and bar 40 form a handle for the anchor 10 and serve as a means, via an aperture 44 in the outer end thereof, for tying the anchor to an anchor line, as at 45.

Figures 7, 8, 9, 10, 11, 12:
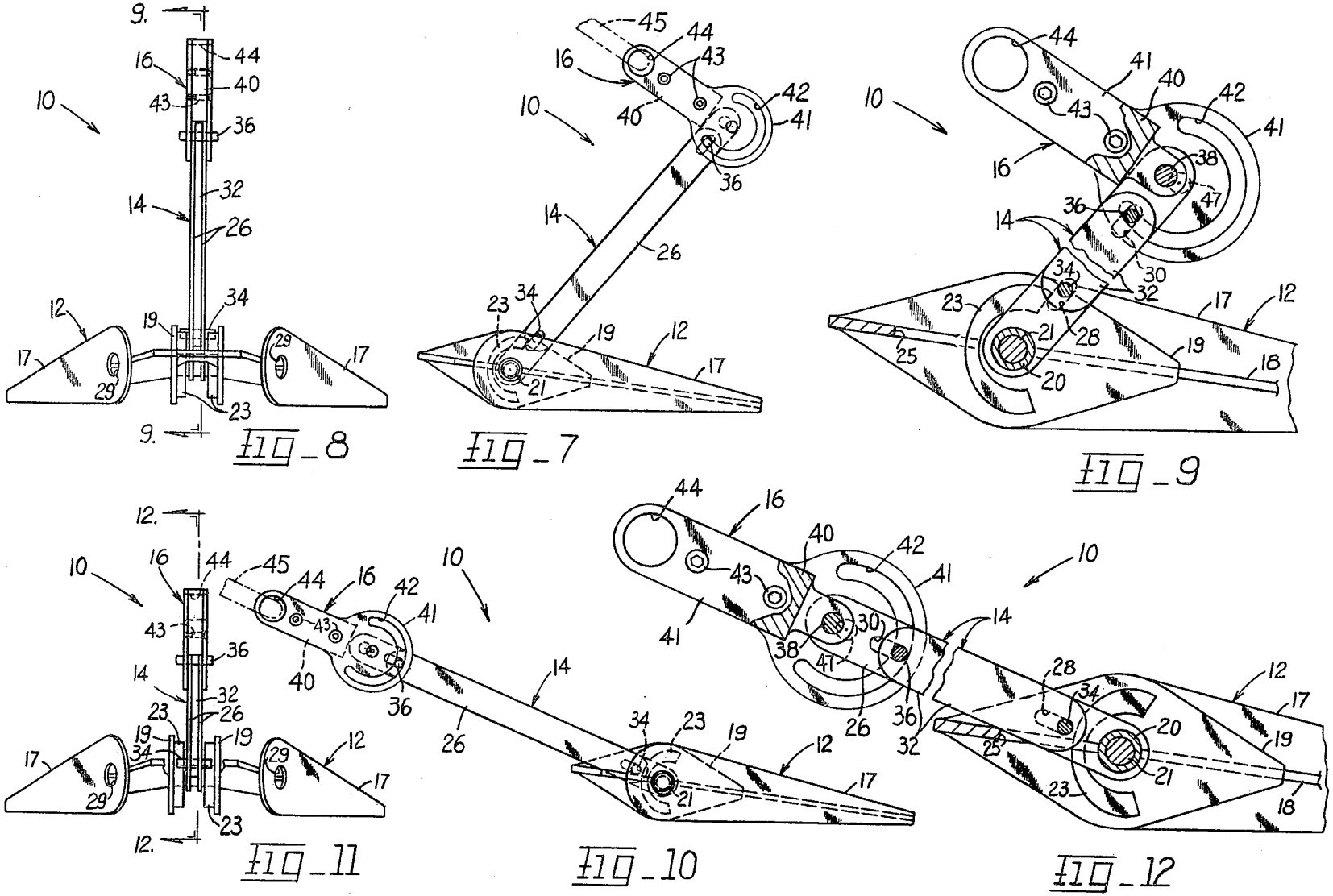
FIGS. 7–9 are views corresponding to FIGS. 1, 2 and 5, respectively, of said embodiment shown in an intermediate release position.
FIGS. 10–12 are views corresponding to FIGS. 1, 2 and 5, respectively, of said embodiment shown in full release position.

The inner end of said center bar 40 is provided with an aperture therein through which said pivot pin 38 extends for pivotally joining together said intermediate and outer shank portions 14 and 16, respectively. The inner ends of the plates 41 are substantially circular in shape and have central apertures 47 and circular slots 42 formed therein; the radii for said slots 42 being the centers of said apertures 47. The aforementioned laterally projecting pins 36 which are fastened to the center plate 32 project through the slots 42 so that the movement of said center plate 32 relative to the plates 26 and to the stops 23 is controlled by the position of the outer shank portion 16 relative to the intermediate shank portion 14. The reason for this is that the slots 42 are eccentrically disposed in respect to the pivot pin 38 as can be seen in the drawings, particularly FIGS. 1, 5, 7, 8, 10 and 12. Thus, when the intermediate and outer shank portions 14 and 16, respectively, are aligned with each other in an anchor drag position, as shown in FIGS. 1–6, the pivot pin 38 and 36 are farthest apart; and when the intermediate and outer shank portions 14 and 16, respectively, are at right angles to each other in an intermediate release position, as shown in FIGS. 7–9, the pivot pin 38 and pin 36 are closest to each other. This means that in FIGS. 1–6 the center plate 32 is held in its lowered position by the action of the slot 42 on the pin 36 and thus the pin 34 is moved to its lowered position in the slots 28 and held against a set of shoulders on the stops 23; in this condition the intermediate shank portion 14 is prevented from rotating in respect to the fluke body 12. In FIGS. 7–9 the center plate 32 is held in its raised position by the action of the slot 42 on the pin 36 and thus the pin 34 is moved to its raised position in the slots 28 and held above and free of the stops 23; in this condition the intermediate shank portion 14 is free to rotate in respect to the fluke body 12.

In operation of said anchor 10, the same is a double-acting anchor in that said anchor 10 will dig into the sea bottom in either of diametrically opposite directions depending upon how the anchor 10 strikes said sea bottom. In other words, the fluke body 12 can pivot in respect to said intermediate shank portion 14 between two different anchor drag positions; said fluke body 12 is capable of pivoting approximately 120 degrees in respect to said shank portion 14 when moving between said two anchor drag positions. For example, FIGS. 1–6 illustrate an anchor drag position for said anchor 10 which is capable of holding a boat tending to move from left to right in reference to FIG. 1. In this anchor drag position the two shank portions 14 and 16 are axially aligned and the fluke body 12 makes about a 60 degree angle with said shank and the pin 34 is disposed against a set of shoulders on said stops 23 so that said shank and fluke body 12 are locked against pivotal movement relative to each other. Were the boat tending to move from right to left then the fluke body 12 would be pointing to the left (rather than to the right as shown in FIG. 1) and the shank would extend upwardly and to the left (rather than upwardly and to the right as shown in FIG. 1) and the pin 34 would be disposed against the opposite set of shoulders on said stops 23. The pin 34 is disposed in the lowermost position in the slots 28 and held against the stops 23 due to the action of the cam slots 42 on the pin 36 as described.

In this anchor drag position for the anchor 10 with the shank portions 14 and 16 axially aligned and the pin 34 against the stops 23 the fluke body 12 is locked against rotation and the boat is held anchored where the boat user desires. When the boat user desires to lift anchor and get underway he merely has to hoist up the anchor 10. In those relatively rare instances when the anchor 10 may get caught in rocks or other obstructions the boat user does not have to cut the anchor line 45 and lose the anchor 10 as is the case with most commercially available boat anchors on the market today. Assume that the anchor 10, while in the position shown for it in FIGS. 1–6, is caught on rocks so that said anchor 10 cannot be pulled aboard the boat. In this event the boat user merely has to propel said boat in a diametrically opposite direction from which it was at anchor (most usually in the opposite direction of the current or wind) so that said boat moves from right to left in reference to FIG. 1. In this reverse movement of said boat an intermediate release position for said anchor 10 is first attained in which the shank portion 16 is disposed at about 110 degrees in respect to the shank portion 14. This intermediate release position for said anchor 10 is illustrated in FIGS. 7–9. The pivotal movement of said shank portion 16 in respect to the shank portion 14 into the position shown in FIGS. 7–9 moves the pin 36 to an end of the cam slots 42 where the pin 36 is positioned closest to the pivot pin 38 due to the eccentricity of the cam slots 42. The pin 36 is then positioned near the uppermost end of the slots 30 which causes the pin 34 to be raised above the stops 23 and allows the shank portion 14 to rotate in respect to said fluke body 12 in a counterclockwise direction in respect to FIGS. 7 and 9. Continued movement of the boat in the release direction stated causes the anchor 10 to move into its full release position as shown in FIGS. 10–12 in which it can be seen that said intermediate shank portion 14 has rotated counterclockwise in respect to said fluke body 12 and the shank portion 16 has moved into axial alignment with the shank portion 14. In this full release position of the anchor 10 the pin 34 has moved behind the stop 23 and the included angle between said intermediate shank portion 14 and the fluke body 12 is nearly 180 degrees. Continued movement of the boat in this release direction will pull the anchor 10 free of the rocks or other obstructions in which it was captured. The anchor line 45 can then be pulled in to pull the anchor 10 aboard the boat.

It will thus be seen that there has been provided by my invention an improved releasable boat anchor of the double-acting type in which the object hereinabove set forth, together with many thoroughly practical advantages, has been successfully achieved. While a preferred embodiment of my invention has been showed and described, it is to be understood that variations and changes may be resorted to without departing from the spirit of my invention as defined by the appended claims. As one example, the outer shank portion 16 can be fabricated in one piece in which case the apertures 47 would be eliminated and the pin pivot 38 would be made to extend entirely through said outer shank portion 16 from face to face thereof.

What I claim is:

1. An improved releasable boat anchor of the double-acting type for anchoring a boat and for releasing itself from an underwater obstruction in which said anchor may be captured, said anchor comprising a fluke body and a shank, said shank comprising an intermediate portion pivotally connected to said fluke body and an outer portion pivotally connected to said intermediate portion, said outer shank portion having means for attaching an anchor line to said anchor, said anchor having two alternate anchor drag positions, an intermediate release position and a full release position, said intermediate shank portion cosisting of at least one member axially fast and another axially moveable in respect to said fluke body, said axially fast member being pivotally connected at its lower end to said fluke body and at its upper end to said outer shank portion, respective cooperative means on the outer end of said axially moveable member and on said outer shank portion whereby pivotal movement of said outer shank portion controls the axial movement of said moveable member, said intermediate shank portioan being disposed at an acute angle with respect to said fluke body and being axially aligned with said outer shank portion in each of said anchor drag positions, respective cooperative locking means on the inner end of said axially moveable member and on said fluke body which are relatively moved into locking engagement with each other in each of said anchor drag positions, said intermediate shank portion being disposed at an acute angle with respect to both said fluke body and said outer shank portion in said intermediate release position, said angular positioning of said outer shank portion in said intermediate release position moving said axially moveable member so that the locking means on the inner end thereof moves clear of the locking means on said fluke body, said intermediate shank portion being disposed in a substantially straight line position with respect to said fluke body and being axially aligned with said outer shank portion in said full release position, the locking means on said axially moveable member moving behind the locking means on said fluke body in said full release position so that the pull on said fluke body is substantially from the rear thereof.

2. An improved releasable boat anchor as claimed in claim 1, said cooperative means on the outer end of said axially moveable member consisting of outer pin means, said cooperative means on said outer shank portion consisting of an eccentric cam slot, said cooperative means on the inner end of said axially moveable member consisting of inner pin means, said cooperative means on said fluke body consisting of double-acting stop means, and said axially fast member being double slotted, said outer pin means being moveable both in said cam slot and in one of the slots in said axially fast member, and said inner pin means being moveable in the other of the slots in said axially fast member, said inner pin means being locked against said stop means in each of said anchor drag positions and being clear of said stop means in each of said intermediate and full release positions.

3. An improved releasable boat anchor as claimed in claim 2, said fluke body having twin flukes, said flukes being bridged together at two spaced apart locations thereon, one such bridging being at the rear end of said flukes and the other consisting of a pivot pin for said axially fast member, said pivot pin affixed to said flukes forwardly of said rear end.

4. An improved releasable boat anchor as claimed in claim 3, said intermediate shank member having a pair of said axially fast members, said axially moveable member disposed between the two axially fast members, said stop means consisting of a pair of stop members disposed on opposite sides of said intermediate shank portion and affixed, respectively, to said flukes on the inside walls thereof.

* * * * *